US010401076B2

(12) United States Patent
Platt

(10) Patent No.: US 10,401,076 B2
(45) Date of Patent: Sep. 3, 2019

(54) COOLING AND/OR FREEZING APPARATUS

(71) Applicant: Liebherr-Hausgeräte Ochsenhausen GmbH, Ochsenhausen (DE)

(72) Inventor: Thorsten Platt, Toronto (CA)

(73) Assignee: Liebherr-Hausgeräte Ochsenhausen GmbH, Ochsenhausen (DE)

( * ) Notice: Subject to any disclaimer, the term of this patent is extended or adjusted under 35 U.S.C. 154(b) by 532 days.

(21) Appl. No.: 13/930,412

(22) Filed: Jun. 28, 2013

(65) Prior Publication Data

US 2014/0000305 A1 Jan. 2, 2014

(30) Foreign Application Priority Data

Jun. 29, 2012 (DE) ..... 10 2012 012 987
Aug. 21, 2012 (DE) ..... 10 2012 016 501

(51) Int. Cl.
*F25D 11/00* (2006.01)
*F25D 23/02* (2006.01)
*F25D 23/12* (2006.01)

(52) U.S. Cl.
CPC ..... *F25D 11/00* (2013.01); *F25D 23/028* (2013.01); *F25D 23/126* (2013.01); *F25C 2400/10* (2013.01); *F25C 2400/14* (2013.01); *F25D 2323/122* (2013.01)

(58) Field of Classification Search
CPC . F25D 11/00; F25D 3/04; F25D 3/126; F25D 23/126; F25D 23/028; F25D 2323/122; B67D 2001/0089; F25C 2400/14; F25C 2400/10
See application file for complete search history.

(56) References Cited

U.S. PATENT DOCUMENTS 2,515,395 A 7/1950 Court
3,429,140 A * 2/1969 White ..... F25D 23/126 62/339
5,673,817 A * 10/1997 Mullen et al. ..... 222/94
5,787,724 A * 8/1998 Pohl ..... B67D 1/0858 16/386
6,708,741 B1 * 3/2004 Berry ..... B67D 3/0009 141/351
6,868,692 B2 * 3/2005 Choi ..... F25D 23/028 222/146.6
7,316,124 B2 * 1/2008 Lee ..... F25D 23/126 138/110
7,322,209 B2 * 1/2008 Hwang ..... E05D 11/0081 312/120
7,721,568 B1 * 5/2010 Grutza, Jr. ..... F25D 23/02 222/183

(Continued)

FOREIGN PATENT DOCUMENTS

DE 10322974 A1 12/2004
DE 102010038367 A1 1/2012

*Primary Examiner* — Emmanuel E Duke
(74) *Attorney, Agent, or Firm* — Dilworth & Barrese, LLP

(57) ABSTRACT

The present invention relates to a cooling and/or freezing apparatus with at least one cooled internal space and with at least one door provided with at least one handle, the at least one door configured to close the cooled internal space, wherein the apparatus includes at least one dispenser with at least one delivery opening for the delivery of at least one medium, in particular water and/or ice, wherein the handle includes the delivery opening of the dispenser.

7 Claims, 2 Drawing Sheets

(56) References Cited

U.S. PATENT DOCUMENTS

| | | | | |
|---|---|---|---|---|
| 9,297,574 | B2 * | 3/2016 | Lee | F25D 23/126 |
| 2006/0086127 | A1 * | 4/2006 | Anselmino | F25C 5/22<br>62/340 |
| 2006/0186136 | A1 * | 8/2006 | Wauters | B67D 1/0425<br>222/105 |
| 2007/0204647 | A1 * | 9/2007 | Puthiyaveetil | F25D 23/126<br>62/389 |
| 2009/0057339 | A1 * | 3/2009 | Piscotty et al. | 222/105 |

* cited by examiner

COOLING AND/OR FREEZING APPARATUS

BACKGROUND OF THE INVENTION

The present invention relates to a cooling and/or freezing apparatus with at least one cooled internal space and with at least one door provided with at least one handle, door by means of which the cooled internal space can be closed, wherein the apparatus comprises at least one dispenser with at least one delivery opening for the delivery of at least one medium, in particular water and/or ice.

Cooling and/or freezing apparatuses of the type mentioned at the start are known from the prior art. In these apparatuses, a dispenser for ice and water is located in the door, dispenser by means of which ice or water can be delivered to a user, from a cooled area of the apparatus to the outside through a delivery opening.

Although such dispensers represent a practical possibility of obtaining ice or water or another medium without the door of the apparatus having to be opened, they form interfering contours that sometimes affect the overall visual impression of the apparatus.

SUMMARY OF THE INVENTION

The present invention therefore is based on the problem of further developing a cooling and/or freezing apparatus of the type mentioned at the start, so that the possibility is created for designing the apparatus in such a manner that interfering contours in the area of the door can be dispensed with.

This problem is solved by a cooling and/or freezing apparatus having the characteristics herein. Accordingly, it is provided that the handle comprises the delivery opening of the dispenser.

The present invention is thus based on the notion of using the handle, which is present in any case, as a portion of the dispenser or as the dispenser, and of using it with at least one delivery opening, for example, for the delivery of water or ice or other media. The possibility of conveying, for example, water, through the handle from the interior of the apparatus to the outside, or to deliver water by means of the handle, meets the specification for a door designed without interfering contours and at the same time it meets the requirement of being able to deliver cooled product or frozen product to the outside, without the need to open the door.

In a preferred embodiment of the invention, it is thus provided that the water or another medium is not conveyed to the outside through a separate unit that may affect the design, but instead through the apparatus handle, which is present in any case. However, this does not rule out the presence of additional delivery openings on the apparatus, through which the at least one medium can be delivered. This means that the delivery opening handle does not have to be the only opening through which the medium can be delivered.

A preferred embodiment of the invention consists in that the door itself comprises no delivery opening of the dispenser. As a result of this design of the invention, it is possible to meet the requirement that the door be as simple or as free of interfering contours as possible. Thus, it is preferable to provide that the door itself is designed without dispenser and that the handle represents the only delivery opening through which a delivery of the cooled medium or frozen medium in the door area is possible, without the door having to be opened.

In a further embodiment of the invention, it is provided that the door comprises an outside or front which is made of wood or stainless steel or which comprises wood or stainless steel. In particular, in the case of these high-value apparatus fronts, the goal should be not to have any interfering contours.

In a further embodiment of the invention, it is provided that the apparatus is provided with at least one fixed water connection and/or that it comprises at least one tank which is connected to the handle in such a manner, by means of one or more lines or the like, that the water or another medium is conveyed from the fixed water connection and/or from the tank to the handle. Thus, it is possible to achieve the water supply or the supply of the handle with the medium by means of a fixed water connection of the apparatus and/or by means of a tank which can be located, for example, in the area of the interior wall of the door.

By means of the fixed water connection, the apparatus can be connected to a conventional domestic water pipe system, so that a water supply is always ensured. Alternatively or additionally, it is conceivable to provide at least one tank from which the handle is supplied with the medium to be delivered.

As indicated, the tank can be arranged on or in the door, preferably on or in the interior side of the door. For example, it is conceivable therefore to arrange the at least one tank in at least one position of the interior wall of the door, similar to the arrangement of a door rack. It is preferable to provide that the tank can be removed. In this case, it can be refilled particularly easily by a user.

It is also conceivable to arrange the tank in the heat insulation, particularly in the foam filling of the door, which extends between the interior side and the exterior side of the door. In this case, no useful space is lost due to the tank.

In this case, the tank is connected, through the heat insulation, to the handle, and it comprises moreover a filling opening, through which the tank can be refilled on the user side or also by means of a fixed water connection.

In principle, it is conceivable that the tank is to be refilled manually or also by means of a fixed water connection, for the purpose of which a user must open and close a corresponding valve.

It is also conceivable that at least one filling level sensor is provided, which actuates a valve, through which the tank is automatically refilled by means of a fixed water connection. In this embodiment of the invention, it is possible that the user does not need to be concerned about the filling level in the tank, because an automatic refilling takes place by means of a fixed water connection or by means of a domestic water pipe system connected to said connection.

In a further embodiment of the invention, it is provided that the handle is attached by at least one adapter to the exterior side of the door, and that the water feed line to the handle passes through said at least one adapter.

This embodiment of the invention has the advantage that the feed line to the handle is not visible to the user, since it is arranged in the at least one adapter. It is conceivable to design the at least one adapter so that it is hollow, and to use the hollow space as a line section for feeding the water to the delivery opening.

In addition, the at least one line can be installed along the door interior side and then through the door. For example, in the case of a water tank arranged on the interior side of the door, it is conceivable to install, starting from said tank, a line along the interior door and then through the door to the outside to the adapter of the handle, so that the handle can be supplied accordingly with the medium. The above embodiments naturally apply not only to the delivery of water, but also to the delivery of any conceivable desired medium. For example, depending on the dimensioning, one can also consider, for example, the delivery of ice or crushed ice from the handle.

The design of the handle is largely user-defined. It is particularly advantageous if the handle is designed as a handle bar that is arranged, for example, perpendicularly on the external side of the door or else obliquely on the exterior side of the door, wherein the delivery opening for the delivery of the medium can be formed, for example, by the lower end of the handle bar, or it can be located at least in a lower area, preferably in the lower fourth of the length of the handle bar.

In a further embodiment of the invention, it is provided that the handle or another element of the apparatus is designed with at least one valve or other closure element, by means of which the delivery of the medium can be closed off and opened. For example, it is conceivable to provide the handle with a cap or the like, which when pivoted automatically results in the medium coming out. It is also conceivable to provide a switch which can be actuated, for example, by a cup or the like, or also by the hand of the user, and which, when actuated, results in a valve opening so that the medium can come out.

Moreover, it can be provided that the valve or the other closure element is arranged in such a manner that the actuation of the valve or of the other closure element occurs as a result of the movement, in particular as a result of a pivoting, of a section of the handle.

In this embodiment of the invention, it is provided that the user either by hand or with a vessel pivots a section of the handle, for example, bends it or tilts it about an axis, wherein, as a result of this movement, opening occurs, resulting in the medium coming out. It is conceivable, for example, to design a handle section which is resilient, so that, when this resilient section is bent, a valve or another closure element is deformed in such a manner that the medium can pass through and it drains from the handle or comes out of it.

It is also conceivable to design a section of the handle so it can be pivoted with respect to another stationary section of the handle, and to release or simply close off a valve or a closure element, depending on the pivoting position of this section. Thus it is possible, for example, for the user to pivot, by means of a vessel, a section of the handle, preferably the lower end area of the handle bar, as a result of which, starting at a certain pivoting angle, a valve or another closure element is opened, and the medium can drain into the vessel.

It is also possible to provide the handle simply with a pivoting cap or the like, which, in the pivoted state, opens a delivery opening, and in the state where it is pivoted back, it closes said opening in a sealing manner.

In a further embodiment of the invention, it is provided that at least one locking element is provided, which is connected to the valve or other closure element or to the handle in such a manner that the valve or the closure element can be closed off, wherein it is preferable to provide that the closure element is arranged on and/or in the handle.

In this manner, it is possible to incorporate a childproofing device, for example.

This locking element can be actuated, for example, in a manner similar to the functioning of a ballpoint pen, in that a button is actuated. In a first position, the valve or closure element is released. If the actuation element is actuated again, it is conceivable to lock the valve or the closure element. This can occur, for example, in that the mentioned bending or pivoting of the portion of the handle bar is prevented, wherein a removal of the medium is ruled out.

The mentioned locking element can be located, for example, in an upper area and preferably in the upper end area of the handle bar, so that it is not accessible to children.

Moreover, it is conceivable to design the handle in such a manner that it is moved back automatically from a release position, in which a medium can be delivered, into its locked position, for example, by means of springs or other resilient resetting forces, so that the valve or other closure element is closed off. This prevents the accidental escape of medium, although no user is actuating the dispenser.

In order to prevent the formation of drops in the area of the delivery opening, it is possible to provide a sponge-like material in the area of the handle or of the delivery opening, which collects drops when the vessel has already been removed. It is also possible to provide the handle with one or more openings through which the drops or the medium can evaporate, when no medium is being removed.

BRIEF DESCRIPTION OF THE DRAWINGS

Additional details and advantages of the invention are explained in further detail in reference to an embodiment example represented in the drawing. The drawings show.

DESCRIPTION OF THE PREFERRED EMBODIMENTS

Figure 1:
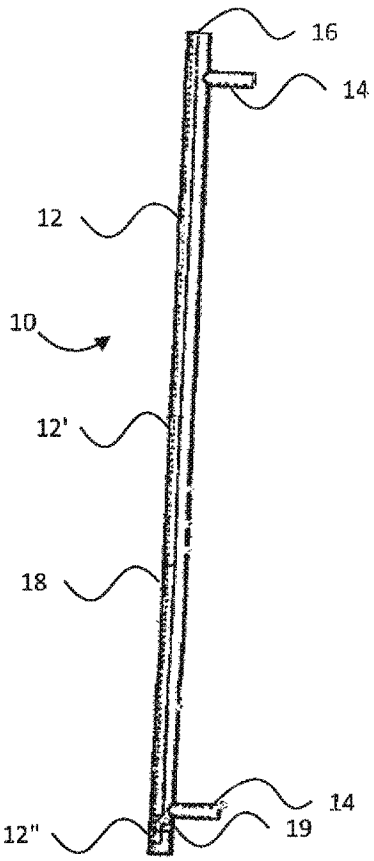
FIG. 1: a diagrammatic side view of the handle according to the present invention in the closed position of the valve.

FIG. 1 shows a handle bar which is mounted vertically on the exterior side of the door. The term "exterior side" denotes here both the front side facing the user and also the side edges of the door.

It is also pointed out here that the term "door" denotes any closure element of a cooling and/or freezing apparatus, that is to say not only doors in the narrow sense that can be pivoted around a vertical pivot axis, but also lids, covers, drawers, etc.

The handle 10 comprises the mentioned handle bar 12 as well as two adapters 14 arranged on said handle bar, by means of which adapters the handle bar 12 is attached to the exterior side of a door.

Through the lower one of the adapters 14 shown, water or another medium is conveyed to the lower end area of the handle bar 12, so that, by means of the handle 10, water or else another medium can be removed on the user side.

The adapter 14 is connected by means of a line to a water tank or to a fixed water connection, wherein the water tank can be arranged, for example, on the interior wall of the door of the apparatus, and the line extends, for example, through the foam filling of the door to the adapter 14.

As can be seen moreover in FIG. 1, the handle bar comprises a stationary section 12' and a movable section 12".

The reference numeral 16 marks the actuation button arranged in the upper end area of the handle bar 12, button which is connected by means of a bar 18 to the area of the handle bar 12 which is movable.

Moreover, as can be seen in FIG. 1, a valve 19 or another closure element, by means of which the draining of water can be closed off and opened, is located in the hollow space of the handle bar 12, either in the stationary section 12' and/or in the movable section 12".

The mentioned bar 18 is connected to the valve 19 or to the movable section 12" of the handle bar 12 in such a manner that the latter, depending on the position of the bar 18, is blocked or released. In the blocked state, a delivery of the medium is not possible.

The actuation of the bar 18 occurs by means of the mentioned actuation button 16 in a manner similar to the functioning of a ballpoint pen. If the actuation button is operated once, the bar 18 is moved into its locking position, so that a removal of the medium is ruled out. If the button 16 is moved again, the bar 18 is moved into a position in which the valve 19 can be opened or in which a swiveling of the movable section 12" is possible, so that the medium can be removed. The bar 18 can act on the valve or closure element and/or on the movable section of the handle.

As a result of the repeated actuation of the actuation button 16, the locking position as well as the release position can be set alternately in a manner similar to a ballpoint pen.

Figure 2:
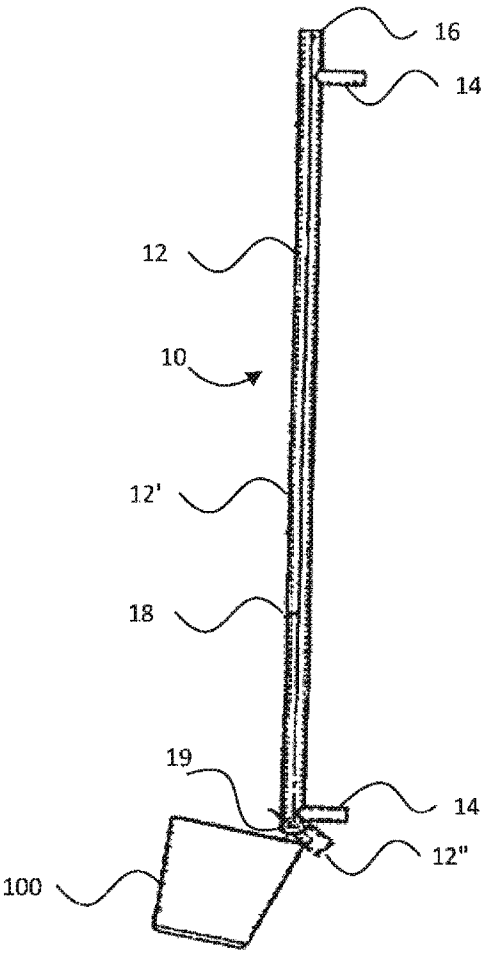
FIG. 2: a diagrammatic side view of the handle according to the present invention with the valve open.

FIG. 2 shows the handle 10 according to FIG. 1 in the position in which it is actuated on the user side. In order to be able to remove water or another medium from the hollow space of the handle 10 or of the handle bar 12, the user contacts the movable section 12" of the handle bar 12 with a vessel 100 in such a manner that said section is pivoted or bent with respect to the stationary section 12', as can be seen in FIG. 2. Starting with a certain pivoting angle, the valve 19 is actuated in such a manner that the water escapes through the lower adapter 14, through the lower hollow section of the bar 12, and it reaches the vessel 100, as indicated by the arrow in FIG. 2. Thus, there is no need for the user to touch by hand an actuation element or the like in order to be able to remove the medium. It is sufficient if, with a vessel, the movable section 12" of the handle bar 12 is moved, as can be seen in FIG. 2, so that overall a particularly hygienic design is achieved.

Naturally, other actuation mechanisms are also possible, such as, for example, a switching element or button in the area of the handle bar or on the door, by means of which the valve 19 can be actuated.

Moreover, it should be pointed out that the valve 19 does not necessarily have to be located in the hollow space of the handle bar 12; instead, for example, it can also be arranged in the adapter 14 or else at another site.

If the vessel 100 is moved again away from the position represented in FIG. 2, it is conceivable that the movable section 12" is automatically moved, for example, by spring force or the like, back into the position represented in FIG. 1, so that a discharge of the medium is prevented.

Besides that, in the position represented in FIG. 1, the filling tube or the filling area of the handle bar is protected by the movable element 12".

As can also be seen from FIG. 1, the movable element 12" of the handle bar 12 of hollow design is arranged, in the closed position, in such a manner that it is aligned with the stationary area of the handle bar, so that overall an appealing uniform overall visual impression is produced. The handle bar can thus not be distinguished in the unactuated state from a conventional handle bar.

To supply the handle or the handle bar 12 of hollow design with water, it is possible to arrange one or more water tanks in the cooled internal space and preferably on the interior side of the door.

It is conceivable to provide different water tanks which can be filled with different media.

Thus, it is also possible to connect the handle bar or the hollow space thereof to several different water tanks, so that the user himself/herself can decide which drink or medium he/she would like to remove. A selection can made, for example, in that the movable area 12" of the handle bar 12 is moved either to the right or to the left, depending on which drink or medium the user wants, or by providing different switches, valves or the like by means of which different media can be removed.

It would be conceivable to use, for example, two adapters 14 for the supplying of the medium, and not only the lower one or only the upper one.

The water tank or the feed line to the water tank or also the area between the water tank and the dispenser opening of the handle can be designed with at least one filter in order to ensure a cleaning of the delivered water.

As already explained above, it is conceivable to design the water tank with a sensor which measures the filling level. If there is a need to refill, it is possible to refill the water tank, for example, by means of a line installed in the upper area of the inner container, line which itself is connected to a fixed water connection of the apparatus which in turn is connected to a water supply line of the household.

Figure 3:
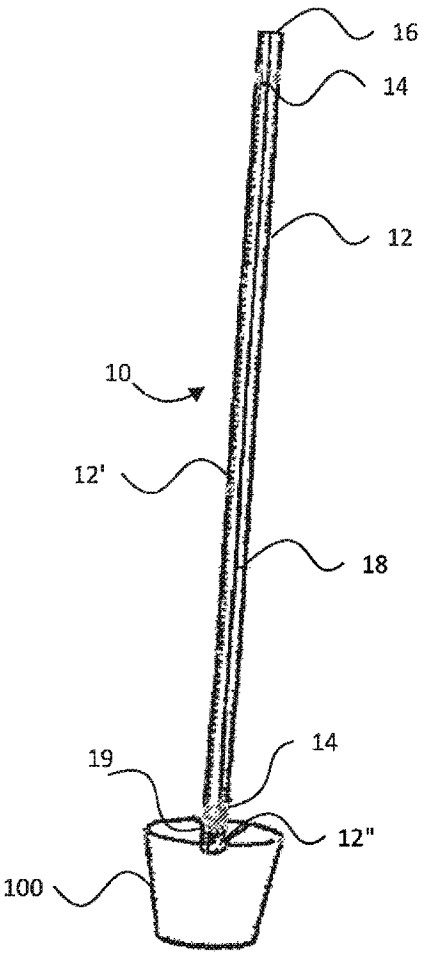
FIG. 3: a top view of the handle of the apparatus according to the invention according to FIG. 2 from the right.

FIG. 3 shows the arrangement according to FIG. 2 in a view from the right. In the area of the opening and closing mechanism or in the area of the valve 19, a sponge-like material can be arranged, in order to collect the last drops after the filling, when the vessel 100 has been removed. A hole or a recess or several holes or recesses in the handle can be used to evaporate the water collected in this manner, over time. In this manner, it is prevented that a larger quantity of water collects in the handle area.

Figure 4:
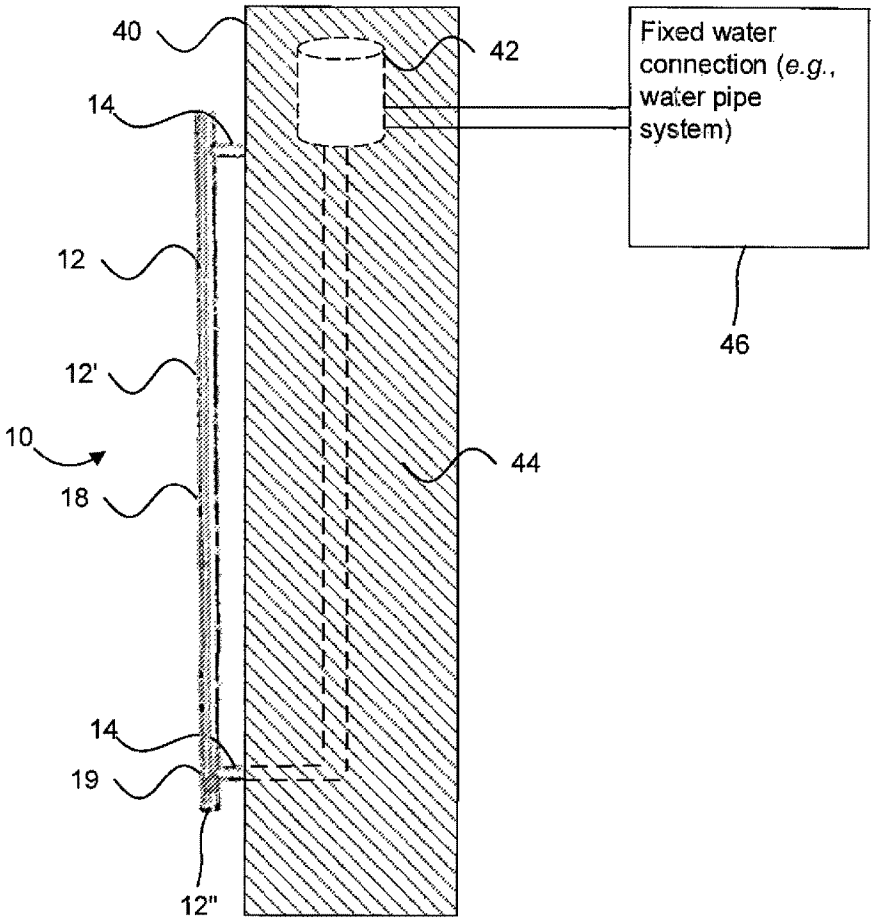
FIG. 4: A plan view of the handle of the apparatus on a door of a refrigerator in accordance with the disclosure.

FIG. 4 is an example of one embodiment of the overall dispenser system described above. For example, FIG. 4 illustrates handle 12 attached to door 40. Further, FIG. 4 depicts the handle connected to tank 42, the tank 42 being within the heat insulation 44 (e.g., foam filling) of door 40. The tank, in turn, is connected to a fixed water connection 46, such as a water pipe system.

By means of the present invention it is possible to prevent an interference with the apparatus front by interfering contours and particularly by a dispenser, since the apparatus handle is used to convey water or another medium to the outside. A door opening is not required, so that this arrangement is particularly convenient and efficient.

Moreover, it is conceivable to make the present invention available in the form of a retrofitting set. Here, it is conceivable that in this case a door rack is replaced by a water tank, a line is led from the water tank to the handle, and the handle is retrofitted accordingly, for example, according to FIGS. 1-3. The water line can be led along the door or through the door to the adapter of the handle and from the latter into the inner hollow area of the handle bar 12.

The represented embodiment examples relate to a handle bar or to a handle the lower portion of which can be swung down. This is only an embodiment example of the invention. It is also conceivable, for example, to design the handle so it is resilient in its entirety or in the lower area, and to release a valve by pressure applied to the external surfaces of the handle, so that water can run out. In principle, the scope of the invention also covers other possibilities for triggering a valve or a closure element.

In delivery or dispensing devices known from the prior art there is weakened insulation in the affected areas in the door of the apparatus. By means of the present invention, this disadvantage can be avoided, since, in a preferred embodiment of the invention, only the lead-through to the handle has to be produced, without having to weaken the insulation in entire areas of the door. Thus, a weakening of the insulation over a larger area does not occur, which is preferable.

The invention claimed is:

1. A cooling and/or freezing apparatus defining at least one cooled internal space, and comprising: a door configured to close the at least one cooled internal space; two adapters mounted on the door, with one of the adapters having a channel therethrough; a handle attached to the door via both adapters and spaced away from the door, with the handle including a handle bar having a stationary component and a moveable component situated on opposite sides of the adapter having the channel therethrough; and the stationary component being hollow and having an actuating bar extending therethrough to contact the movable component and tilt the same upon actuation to open the adapter channel, such that repeated depressing of an end of the actuating bar opposite an end contacting the movable component alternately opens and closes the adapter channel.

2. The cooling and/or freezing apparatus according to claim 1, wherein the apparatus is provided with at least one fixed water connection or comprises at least one tank, and the at least one fixed water connection or the at least one tank is connected to the dispenser.

3. The cooling and/or freezing apparatus according to claim 2, wherein the at least one tank is arranged on or in the at least one door.

4. The cooling and/or freezing apparatus according to claim 3, wherein the at least one tank is arranged on or in the interior wall of the at least one door and/or in a heat insulation.

5. The cooling and/or freezing apparatus according to claim 4, wherein the at least one tank is arranged in a foam filling of the at least one door.

6. The cooling and/or freezing apparatus according to claim 2, wherein the at least one tank is arranged to be removable and/or connectable to the at least one fixed water connection to be refillable through the at least one fixed water connection.

7. The cooling and/or freezing apparatus according to claim 1, additionally comprising a button situated on the end of the actuating bar opposite the end contacting the movable component, such that repeated depressing of the button alternately opens and closes the adapter channel.

* * * * *